US010400533B2

(12) United States Patent
Gordon et al.

(10) Patent No.: US 10,400,533 B2
(45) Date of Patent: Sep. 3, 2019

(54) SYSTEM AND METHOD FOR A DOWNHOLE HANGER ASSEMBLY

(71) Applicant: HALLIBURTON ENERGY SERVICES, INC., Houston, TX (US)

(72) Inventors: Scott Alistair Gordon, Castlewellan (GB); Jack Gammill Clemens, Fairview, TX (US); Paul David Ringgenberg, Frisco, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 20 days.

(21) Appl. No.: 15/565,840

(22) PCT Filed: Jun. 3, 2015

(86) PCT No.: PCT/US2015/034059

§ 371 (c)(1),
(2) Date: Oct. 11, 2017

(87) PCT Pub. No.: WO2016/195682

PCT Pub. Date: Dec. 8, 2016

(65) Prior Publication Data

US 2018/0112481 A1 Apr. 26, 2018

(51) Int. Cl.

| | |
|---|---|
| ***E21B 47/14*** | (2006.01) |
| ***E21B 23/01*** | (2006.01) |
| ***E21B 47/01*** | (2012.01) |
| ***E21B 47/12*** | (2012.01) |
| ***E21B 43/10*** | (2006.01) |

(52) U.S. Cl.

CPC ..... *E21B 23/01* (2013.01); *E21B 43/10* (2013.01); *E21B 47/01* (2013.01); *E21B 47/12* (2013.01); *E21B 47/14* (2013.01)

(58) Field of Classification Search

CPC ..... E21B 43/10
USPC ..... 166/382
See application file for complete search history.

(56) References Cited

U.S. PATENT DOCUMENTS

| | | | | |
|---|---|---|---|---|
| 6,516,663 | B2 | 2/2003 | Wong | |
| 6,684,953 | B2 | 2/2004 | Sonnier | |
| 7,857,052 | B2 | 12/2010 | Giroux et al. | |
| 7,954,563 | B2 | 6/2011 | Mock et al. | |
| 2003/0000300 | A1 * | 1/2003 | Wong | E21B 47/04 73/152.14 |

(Continued)

OTHER PUBLICATIONS

Slickline Downhole Power Unit Tool; Integrated Cased Hole Through-Tubing Services; Halliburton; Wireline & Perforting; H09463; Sep. 2012.

(Continued)

*Primary Examiner* — Taras P Bemko
(74) *Attorney, Agent, or Firm* — Polsinelli PC

(57) ABSTRACT

A downhole hanger assembly having a downhole hanger and a telemetry unit. The telemetry unit can reside within the downhole hanger or the telemetry unit can reside in a telemetry component which is coupled with the downhole hanger. The downhole hanger assembly can be lowered into a wellbore tubular and set against an interior wall of the wellbore tubular. The telemetry unit can receive and transmit data uphole and/or downhole. The data can be received from another telemetry unit and/or from a tool assembly, such as a sensor.

19 Claims, 5 Drawing Sheets

(56) References Cited

U.S. PATENT DOCUMENTS

| | | | | |
|---|---|---|---|---|
| 2011/0205847 | A1 | 8/2011 | Lemenager | |
| 2015/0121124 | A1* | 4/2015 | Hillesund | G06F 11/0745 714/5.1 |

OTHER PUBLICATIONS

High-Expansion Gauge Hanger; Integrated Cased Hole Through-Tubing Services; Halliburton; Wireline & Perforting; H09860; Jan. 2013.

DynaLink® Telemetry System Brochure; Reliable, real-time, wireless downhole communication; Halliburton; Testing & Subsea; H07823; Jul. 2011.

DynaLink® Telemetry System; Reliable Wireless Downhole Telemetry Technology; Data Acquisition; Halliburton; Testing & Subsea; H04930; Mar. 2015.

Halliburton; Products & Services; Reservoir Testing/Analysis; Data Acquisition; DynaLink™ Telemetry System Overview: DynaLink™ Telemetry System; 2014; http://www.halliburton.com/en-US/ps/testing-subsea/reservoir-testing-analysis/data-acquisition/dynalink.page#.

Well Testing Data Acquisition Brochure; test Tools; Data Acquisition Services; Fluid Sampling & Analysis; Surface Well Testing; Halliburton; Testing & Subsea; Apr. 2014.

Halliburton Well Testing Brochure; Data Acquisition Services; Fluid Sampling & Analysis; Surface Well Testing; Halliburton; Testing & Subsea; H08981; Feb. 2012.

Haddad et al; Application of Telemetry Technology in High-Pressure Wells to Improve Data Accuracy in Drill Stem Tests; SPE Oil and Gas India Conference and Exhibition, Jan. 20-22, Mumbai, India; Society of Petroleum Engineers, 2010.

International Search Report and Written Opinion; PCT Application No. PCT/US2015/034059; dated Feb. 26, 2016.

* cited by examiner

SYSTEM AND METHOD FOR A DOWNHOLE HANGER ASSEMBLY

CROSS-REFERENCE TO RELATED APPLICATIONS

This application is a national stage entry of PCT/US2015/034059 filed Jun. 3, 2015, said application is expressly incorporated herein in its entirety.

FIELD

The present disclosure generally relates to a downhole hanger assembly, and more specifically to a downhole hanger assembly having a downhole hanger and a telemetry unit for transmitting data uphole and/or downhole while the downhole hanger assembly is set against an interior wall of a wellbore tubular.

BACKGROUND

While conducting operations in a well, such as a gas or oil wellbore servicing station, it is often necessary to send and/or to receive data along a work string contained within the wellbore to communicate with downhole tools, such as a sensor in a downhole tool assembly. In conventional systems, the tool assemblies are typically coupled to the outside of a wellbore tubular and are able to obtain data, such as sensor data for the annulus region around the tool assembly. The tool assembly can include a telemetry unit, or a transceiver, communicatively coupled with a tool, such as a sensor. The telemetry unit can receive data, such as commands and/or sensor, and transmit data, such as commands and/or sensor data.

For some wells, the data is wirelessly transmitted uphole and/or downhole via a telemetry system, such as the DynaLink® Telemetry System by Halliburton Energy Services, Inc. The telemetry system can run from the surface to the downhole tools, such as a bottom hole sampler tool, with one or more telemetry units in between. For example, for a 17,000 foot well, the telemetry system can include sixteen (16) telemetry units. Typically, the telemetry systems are externally located on a wellbore tubular. For example, the telemetry units are coupled with a wellbore tubular using one or more straps or other means known to one of ordinary skill in the art. The telemetry system can be bidirectional. For example, the telemetry units can receive data, such as commands, and transmit the data to a tool assembly. The command can be to activate a sensor to obtain data. The telemetry units can also receive data from a tool assembly, such as sensor data, and transmit the data uphole. The telemetry units can also serve as repeaters for transmitting data downhole, such as commands, and for transmitting data uphole, such as sensor data. For example, a telemetry unit can receive data from an uphole telemetry unit and transmit the data to a downhole telemetry unit and vice versa.

DETAILED DESCRIPTION

Figure 1:
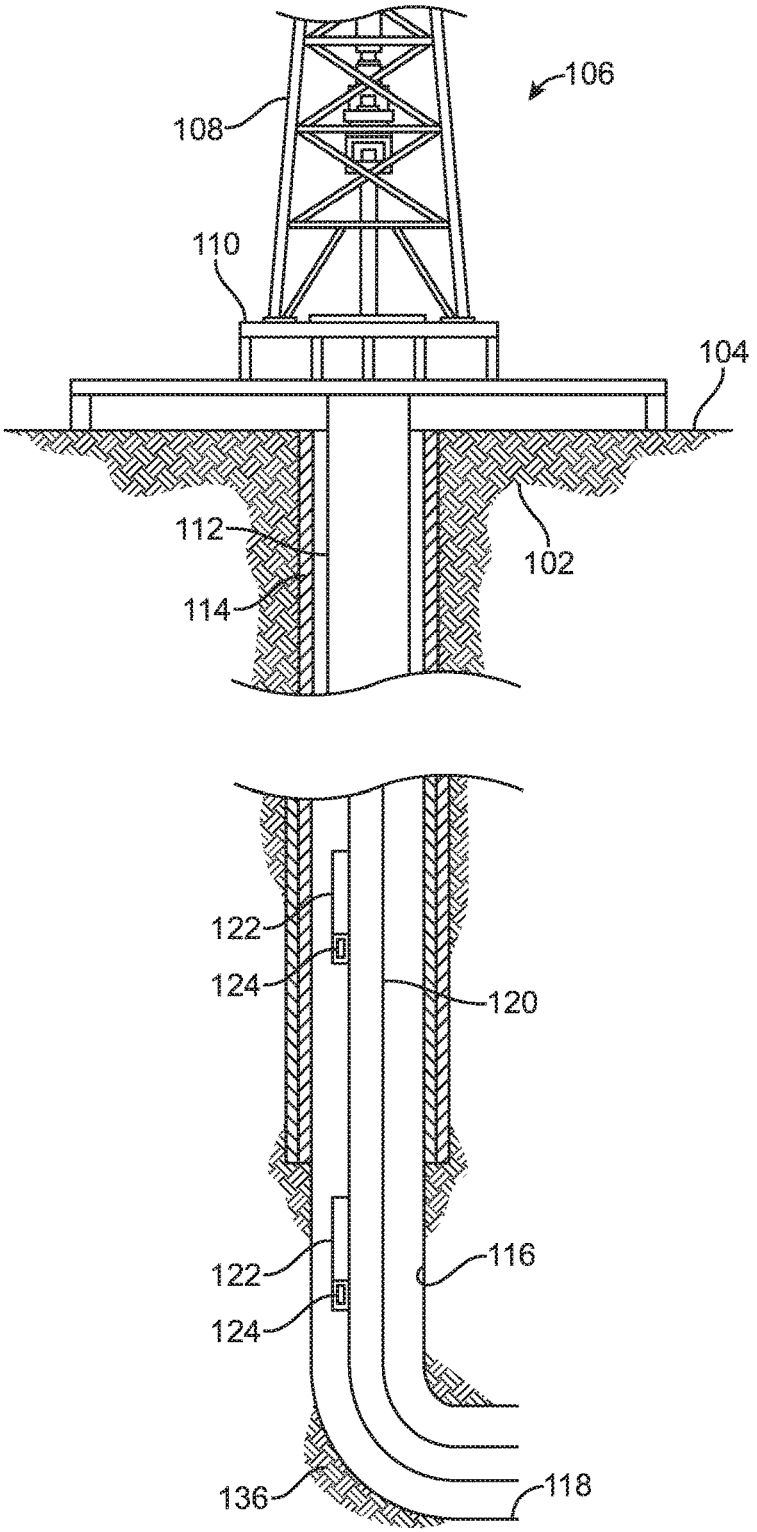
FIG. 1 is an overview of a wellbore servicing station in accordance with an exemplary embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. The drawings are not necessarily to scale and the proportions of certain parts can be exaggerated to better illustrate details and features. The description is not to be considered as limiting the scope of the embodiments described herein.

The term "coupled" is defined as connected, whether directly or indirectly through intervening components, and is not necessarily limited to physical connections. The term "substantially" is defined to be essentially conforming to the particular dimension, shape or other word that substantially modifies, such that the component need not be exact. For example, substantially rectangular means that the object in question resembles a rectangle, but can have one or more deviations from a true rectangle. The phrase "wellbore tubular" is defined as one or more types of connected tubulars as known in the art, and can include, but is not limited to, drill pipe, landing string, tubing, production tubing, jointed tubing, coiled tubing, casings, liners, combinations thereof, or the like. The term "transceiver" is defined as a combination of a transmitter/receiver in one package but can include a separate transmitter and a separate receiver in one or more packages.

The present disclosure relates to a downhole hanger assembly having a downhole hanger and a telemetry unit which can be used for replacement of a telemetry unit of a telemetry system. For example, one or more telemetry units provided in a wellbore can become inoperable. According to the present disclosure, replacement can be conducted without removing a communication string, tubular and/or other string having telemetry units and then reinstalling such string, thereby saving intensive time and expense associated with removal and reinstallation. One non-limiting example of a telemetry system includes DynaLink® Telemetry System by Halliburton of Houston, Tex.

In the course of completing an oil and/or gas well, a wellbore is drilled from the earth's surface into a subterranean production zone. Often included in the downhole apparatus are a variety of tool assemblies to perform tasks associated with drilling, completion, and maintenance of the wellbore. For example, tool assemblies comprising downhole sensors can be attached to a wellbore tubular to measure various wellbore and subterranean formation parameters including, but not limited to, pressure, temperature, resistivity, and/or porosity. The measurement results can provide important information for an operator on the surface of a rig site to make field-development decisions. To communicate with the one or more tool assemblies, one or more corresponding telemetry units can be communicatively coupled with the one or more tool assemblies. One approach of downhole tool deployment is to attach one or more downhole tool assemblies and one or more telemetry units to the outside of a wellbore tubular at the surface, and then lower them into the subterranean wellbore together.

Referring to FIG. 1, a wellbore operating environment in accordance with an exemplary is illustrated. As shown, the operating environment comprises a workover and/or drilling rig 106 that is positioned on the earth's surface 104 and extends over and around a wellbore 114 that penetrates a subterranean formation 102 for the purpose of recovering hydrocarbons. The wellbore 114 can be drilled into the subterranean formation 102 using any suitable drilling technique. As shown, the wellbore 114 extends substantially vertically away from the earth's surface 104 over a vertical wellbore portion 116, deviates from vertical relative to the earth's surface 104 over a deviated wellbore portion 136, and transitions to a horizontal wellbore portion 118. In alternative operating environments, all or portions of a wellbore 114 can be vertical, deviated at any suitable angle, horizontal, and/or curved. The wellbore 114 can be a new wellbore, an existing wellbore, a straight wellbore, an extended reach wellbore, a sidetracked wellbore, a multilateral wellbore, and other types of wellbores for drilling and completing one or more production zones. Further, the wellbore 114 can be used for both producing wells and injection wells. The wellbore 114 can also be used for purposes other than hydrocarbon production such as geothermal recovery and the like. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figures, the uphole direction being toward the surface of the well and the downhole direction being toward the toe or bottom of the wellbore 114; these directions are merely illustrative in nature and do not limit the scope of the disclosure.

A wellbore tubular 120 can be lowered into the subterranean formation 102 for a variety of drilling, completion, workover, treatment, and/or production processes throughout the life of the wellbore. The wellbore tubular 120 can include those provided in the wellbore during completion operations, where hydrocarbon is withdrawn through the wellbore tubular 120 from producing formations. The wellbore tubular 120 can operate in any of the wellbore orientations (e.g., vertical, deviated, horizontal, and/or curved) and/or types described herein. The wellbore can include a wellbore casing 112, which can be cemented into place in at least a portion of the wellbore 114.

The workover and/or drilling rig 106 can include a derrick 108 with a rig floor 110 through which the wellbore tubular 120 extends downward from the drilling rig 106 into the wellbore 114. The workover and/or drilling rig 106 can include a motor driven winch and other associated equipment for conveying the wellbore tubular 120 into the wellbore 114 to position the wellbore tubular 120 at a selected depth. While the operating environment depicted in FIG. 1 refers to a stationary workover and/or drilling rig 106 for conveying the wellbore tubular 120 within a land-based wellbore 114, or alternatively, mobile workover rigs, wellbore servicing units (such as coiled tubing units), and the like can be used to convey the wellbore tubular 120 within the wellbore 114. It should be understood that a wellbore tubular 120 can alternatively be used in other operational environments, such as within an offshore wellbore operational environment.

One or more downhole tool assemblies 122 can be coupled with the wellbore tubular 120 within the wellbore 114. One or more telemetry units 124 can be coupled with the wellbore tubular 120 within the wellbore 114. Typically, the one or more tool assemblies 122 and the one or more telemetry units 124 are coupled on the outside of the wellbore tubular 120 using one or more straps or other means known to one of ordinary skill in the art. Each downhole tool assembly 122 is communicatively coupled with one or more telemetry units 124. Each downhole tool assembly 122 can have a corresponding telemetry unit 124 and/or a single telemetry unit can communicate with one or more downhole tool assemblies 122. Often, performing an operation in the wellbore 114 can require a plurality of different downhole tools. For example, in the completion of a well, a sampling device can sometimes be deployed downhole to collect hydrocarbon samples in a production zone.

Figure 2:
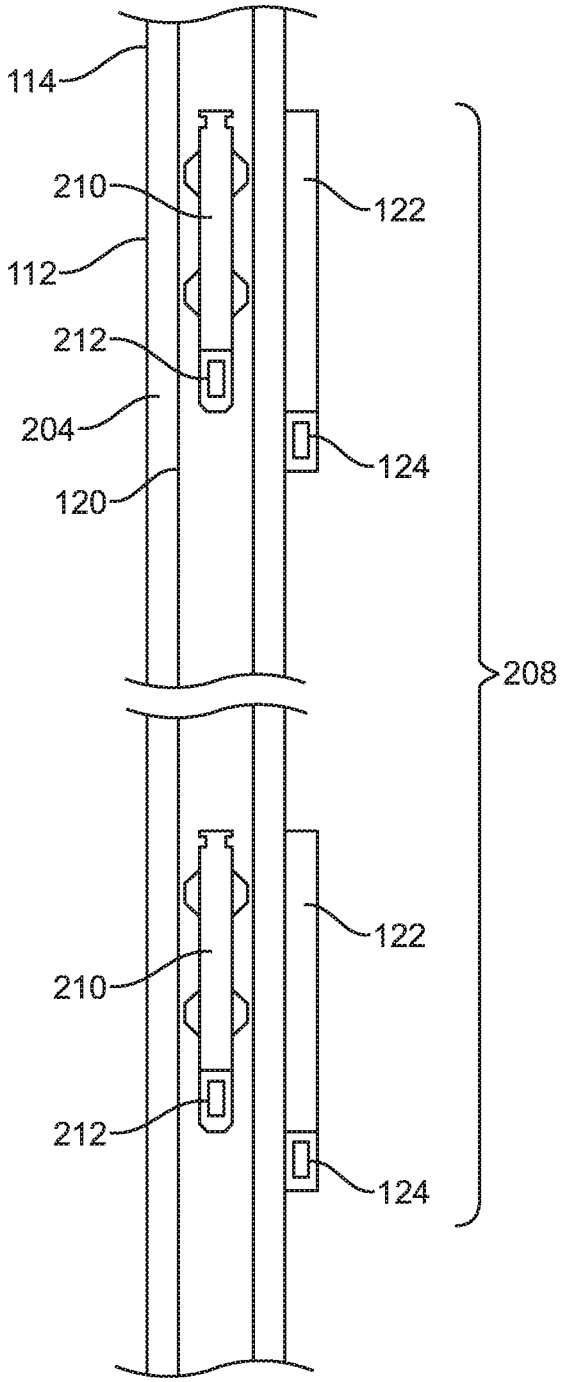
FIG. 2 is a partial view of a wellbore in accordance with an exemplary embodiment.

Referring to FIG. 2, a partial view of a wellbore in accordance with an exemplary embodiment is illustrated. As shown, a wellbore casing 112, the wellbore 114 can include the wellbore tubular 120, an annulus 204, one or more downhole tool assemblies 122, one or more telemetry units 124 of a telemetry system 208 and one or more downhole hanger assemblies 210. The one or more telemetry units 124 of the telemetry system 208 are coupled with an exterior wall of a tubing section of the wellbore tubular 120 using one or more straps or other means known to one of ordinary skill in the art. When one or more of the telemetry units 124 of the telemetry system 208 stops working, a downhole hanger assembly 210 having a telemetry unit 212 can be lowered into the wellbore tubular 120. The telemetry unit 212 of the downhole hanger assembly 210 can be used to "replace" the nonworking telemetry unit 124 of the telemetry system 208 as explained below in more detail. The telemetry unit 212 of the downhole hanger assembly 210 can be the same type of telemetry unit 124 of the telemetry system 208 or can be a different type than the telemetry unit 124 of the telemetry system 208. Typically, the telemetry units 124, 212 are acoustic telemetry systems. Alternatively, other types of telemetry systems can be used, such as radio frequency based telemetry systems. The telemetry units 124, 212 can receive data from one or more tool assemblies 122, such as sensors, and/or from other telemetry units 124, 212. The telemetry units 124, 212 can include a processor and code that is tangibly embodied on a computer-readable medium. The processor can execute the code to cause the telemetry units 124, 212 to analyze the signals and output control signals, a display, alarms, or otherwise, in response to the analysis. The telemetry units 124, 212 can transmit data to one or more tool assemblies 122 and/or to other telemetry units 124, 212. The tool assemblies 122 can be communicatively coupled with one or more telemetry units 124. Alternatively, one or more downhole hanger assemblies 208 can be used when the wellbore 114 does not include a telemetry system 208 or is used to replace an inoperable telemetry system 208.

Figure 3:
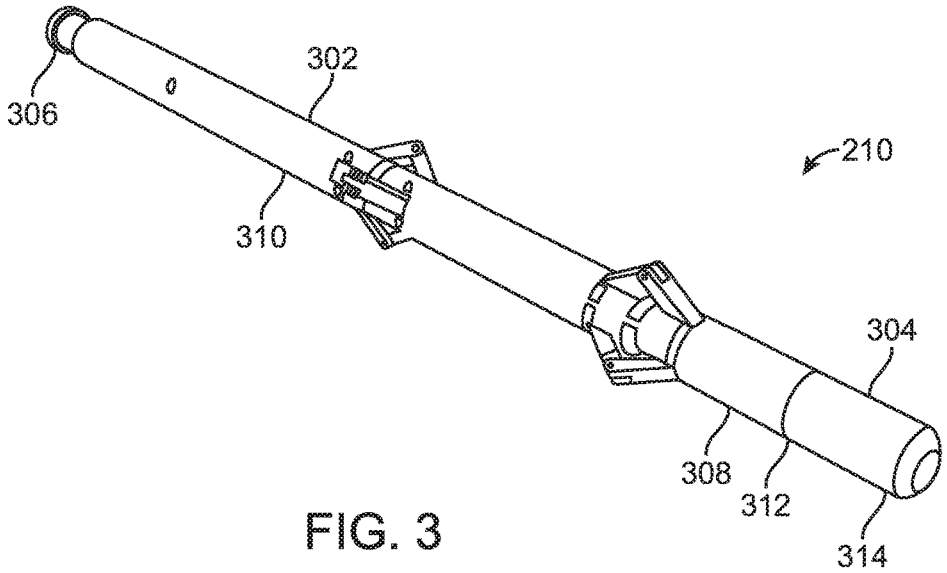
FIG. 3 is a perspective view of a downhole hanger assembly in accordance with an exemplary embodiment.

Referring to FIG. 3, a perspective view of a downhole hanger assembly in accordance with an exemplary embodiment is illustrated. As shown, the downhole hanger assembly 210 includes a downhole hanger 302 and an adapter 304 coupled with the downhole hanger 302. For example, the downhole hanger 302 can be a high-expansion gauge hanger by Halliburton of Houston, Tex. Alternatively, other downhole hangers 302 can be used, such as a liner hanger, other gauge hangers or a vessel capable of being lowered downhole and being positioned within the wellbore 114. The downhole hanger 302 includes a first end 306 and a second end 308, opposite the first end 306. A body 310 couples the first end 306 with the second end 308. The adapter 304 includes a first end 312 and a second end 314 with a telemetry unit 212 (not shown) residing in the adapter 304. As shown, the first end 306 of the downhole hanger 302 includes a male coupler 312 at about the distal end and the second end 308 of the downhole hanger 302 includes a female coupler (not shown) at about the distal end. The first end 312 of the adapter 304 includes a male coupler (not shown) at about the distal end and the second end 314 of the adapter 304 includes a female coupler at about the distal end. One or more adapters 304 can be coupled with the downhole hanger 302. For example, an adapter 304 can be coupled with the second end 308 of the downhole hanger 302. For a downhole hanger assembly 210 having multiple adapters 304, a first adapter 304 can be coupled with the second end 308 of the downhole hanger 302 with a second adapter 304 coupled with the second end 312 of the first adapter 304 and so on. Alternatively, a first adapter 304 can be coupled with the first end 306 of the downhole hanger 302 and a second adapter 304 can be coupled with the second end 308 of the downhole hanger 302. Alternatively, a downhole hanger assembly 210 can include one or more telemetry units 212 residing within the downhole hanger 302.

Figure 4A:
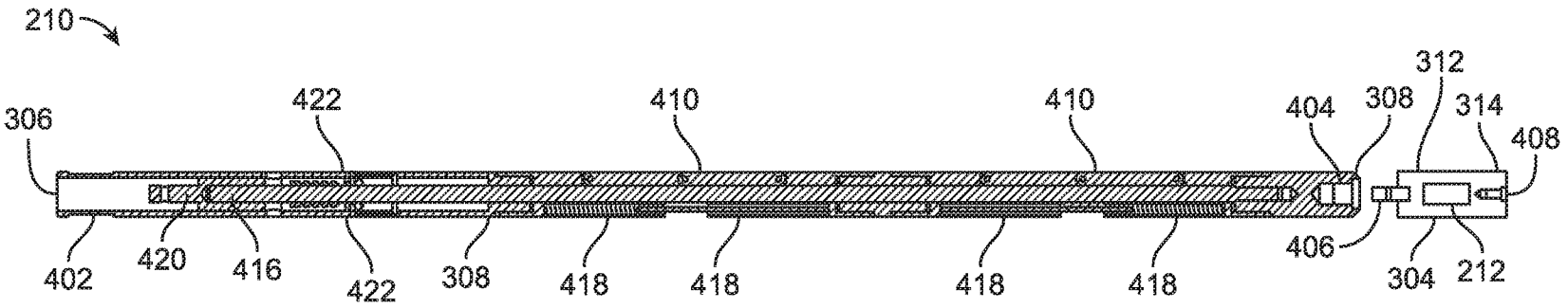
FIG. 4A is an exposed view of a downhole hanger assembly in accordance with a first exemplary embodiment.

Referring to FIG. 4A, an exposed view of a downhole hanger assembly in accordance with a first exemplary embodiment is illustrated. As shown, the downhole hanger assembly 210 comprises a downhole hanger 302 and an adapter 304. The downhole hanger 302 can be coupled with an adapter 304 using a coupler, connection or mating system as known in the art. For example, the downhole hanger 302 can include a male coupler 402 at the first end 306 and a female coupler 404 at the second end 308. Similarly, the adapter 304 can include a male coupler 406 at the first end 312 and a female coupler 408 at the second end 314. The downhole hanger 302 can be coupled with the telemetry component 304 via the female coupler 404 of the downhole hanger 302 coupling with the male coupler 406 of the adapter 304. As shown, the downhole hanger assembly 210 includes one or more sets of slips 410 in a stored state.

Figure 4B:
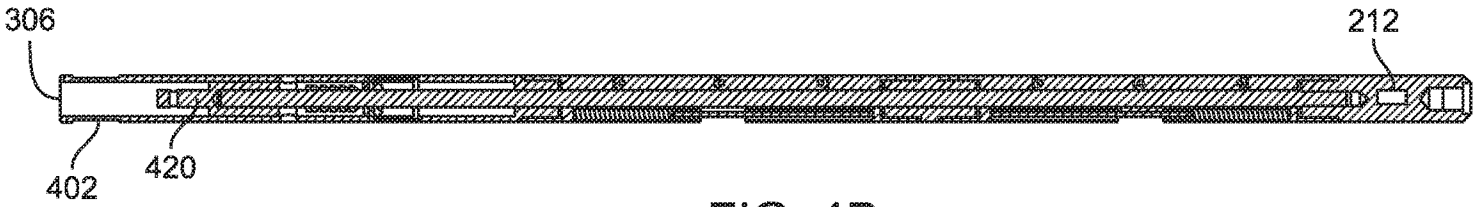
FIG. 4B is an exposed view of a downhole hanger assembly in accordance with a second exemplary embodiment.

Referring to FIG. 4B, an exposed view of a downhole hanger assembly in accordance with a second exemplary embodiment is illustrated. As shown, the downhole hanger assembly 210 comprises a downhole hanger 302 with a telemetry unit 212 residing within the downhole hanger 302. Although the telemetry unit 212 is shown at an end of the downhole hanger 302, the telemetry unit 212 can be located anywhere within the downhole hanger 302 where there is an accommodating space. For example, the telemetry unit 212 can be located at about the middle of the downhole hanger 302 between the sets of slips 410. The downhole hanger 302 can include a male coupler 402 at the first end 306 and a female coupler 404 at the second end 308. As shown, the downhole hanger assembly 210 includes one or more sets of slips 410 in a stored state.

Figure 5:
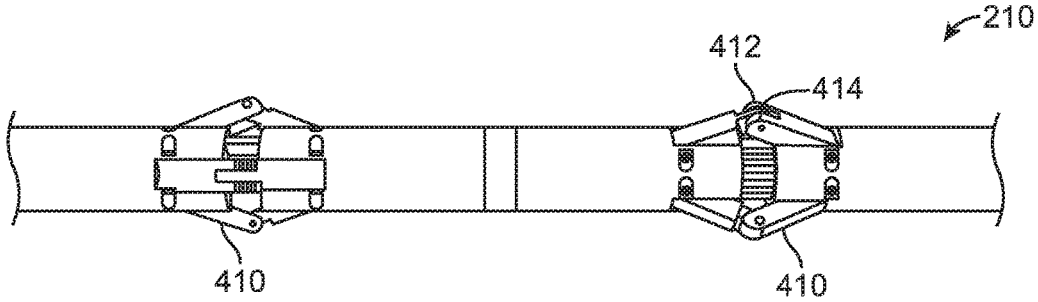
FIG. 5 is an enlarged view of two sets of slips in the deployed state in accordance with a first exemplary embodiment.

Referring to FIG. 5, an enlarged view of a set of slips in a deployed state in accordance with an exemplary embodiment is illustrated. As shown, the set of slips 410 can include gripper pads 412 having teeth 414 to engage with an interior wall of the wellbore tubular 120. To install the downhole hanger assembly 210, a line, such as, a cable, slickline or e-line can be used. The line can include an install tool, as known in the industry, at the down-hole end of the line. For example, a downhole power unit (DPU®) install tool, commercially available by Halliburton Energy Services, Inc., can be used to install the downhole hanger assembly 210. The install tool can be a non-explosive install tool, such as a non-explosive DPU® install tool. The install tool can be communicatively and detachably coupled with a downhole hanger assembly 210. For example, the install tool can include a female coupler at a distal end with the female coupler coupled with a male coupler 402 of the downhole hanger assembly 210. The downhole hanger assembly 210 can be lowered into the wellbore tubular 120 and when the downhole hanger assembly 210 reaches a desired depth, the install tool can deploy the one or more sets of slips 410 as known in the art. For example, when the sets of slips 410 are deployed, the sets of slips 410 extend the gripper pads 412 towards an interior wall of a tubing section of the wellbore tubular 120. This process can be controlled with the gripper pads 412 engaging the interior wall softly.

To install the downhole hanger assembly 210, the install tool causes a threaded core rod 416 to move linearly which causes the one or more slip sets 410 to extend outwardly with the gripper pads 412 engaging the interior wall of the wellbore tubular 120. In response to the movement of the threaded core rod 416, one or more corresponding springs 418 are tightened thereby causing the corresponding gripper pads 412 of a set of slips 410 to expand outwardly and engage the interior wall of a tubing section of the wellbore tubular 120. Upon deployment of the one or more sets of slips 410, the downhole hanger assembly 210 can be self-centered with respect to the wellbore tubular 120 with substantially equal force being distributed by the gripper pads 412 against the interior wall of a tubing section of the wellbore tubular 120.

To remove the downhole hanger assembly 300, a line, such as, a cable, slickline, or e-line can be used. The line can include a pulling tool, as known in the industry, at the down-hole end of the line. The pulling tool can be communicatively and detachably coupled with the downhole hanger assembly 210. For example, the pulling tool can include a female coupler at a distal end with the female coupler coupled with a male coupler 402 of the downhole hanger assembly 210. The pulling tool can apply a pulling force to a pull rod 420 as known in the art. The pulling force releases one or more corresponding shear pins 420 of the downhole hanger 302, which causes the corresponding springs 408 to release. As a result, the one or more sets of slips 410 return to their stored state. Then, the line can be pulled and the coupled downhole hanger assembly 210 can be removed.

Figure 6:
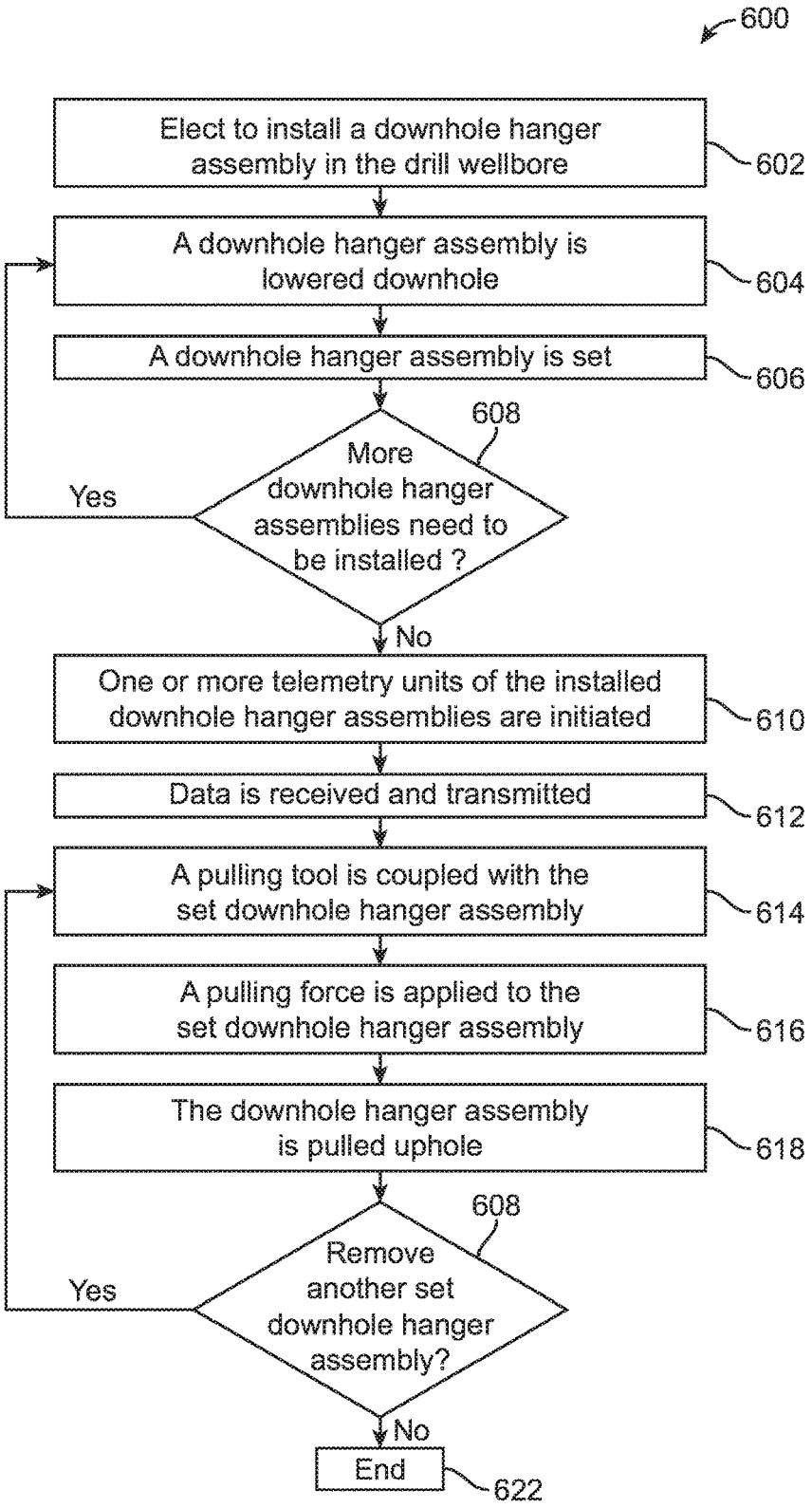
FIG. 6 is a flowchart for a method for installing, using and removing one or more downhole hanger assemblies in accordance with an exemplary embodiment.

Referring to FIG. 6, a flowchart for a method for communicating data via an umbilical in accordance with an exemplary embodiment is illustrated. The exemplary method 600 is provided by way of example, as there are a variety of ways to carry out the method. The method 600 described below can be carried out using the configurations illustrated in FIGS. 1-5 by way of example, and various elements of this figure are referenced in explaining exemplary method 600. Each block shown in FIG. 6 represents one or more processes, methods or subroutines, carried out in the exemplary method 600. The exemplary method 600 can begin at block 602.

At block 602, a downhole hanger assembly can be elected to be installed in the wellbore. For example, a telemetry unit 124 in a telemetry system 208 can stop working or if data needs to be transmitted uphole and/or transmitted downhole, a downhole hanger assembly 300 can be installed. For the former, a telemetry unit 124 in a telemetry system 208 can stop working if a battery associated with the telemetry unit 124 needs to be replaced. For the latter, it can be desirable to install one or more downhole hanger assemblies 210 to transmit data uphole and/or downhole. For example, a tool, such as a sensor, can already be installed but no telemetry system 208 is in place, thus one or more downhole hanger assemblies 210 can be installed. After electing to install a downhole hanger assembly in the wellbore tubular 120, the method 600 can proceed to block 604.

At block 604, a downhole hanger assembly is lowered downhole. For example, a line, such as a cable, slickline or e-line, can be coupled with an installer tool which is coupled with a downhole hanger assembly 210. The downhole hanger assembly 210 can be lowered into the wellbore tubular 120 until a desired depth is reached. The desired depth can be at about where an existing telemetry unit 124 stopped working or where a known tool assembly 122 is located. After reaching the desired depth, the method 600 can proceed to block 606.

At block 606, the downhole hanger assembly can be set. For example, the install tool can cause one or more sets of slips 410 to be deployed securing the downhole hanger assembly 210 to an interior wall of a tubing section of wellbore tubular 120. After setting the downhole hanger assembly, the method 600 can proceed to block 604.

At block 608, a determination is made if more downhole hanger assemblies need to be installed. For example, if one or more telemetry units 124 of the telemetry system 208 are not working, one or more downhole hanger assemblies 210 can be installed. If the downhole hanger assemblies 210 are being used to transmit data to and/or from one or more downhole tools 122, additional downhole hanger assemblies 210 can be installed. When installing multiple downhole hanger assemblies 210, the downhole hanger assemblies 210 are installed with the lowest being installed first and working uphole. In some cases, a lower downhole hanger assembly 210 can be installed even though a corresponding telemetry unit 124 is currently working to ensure that the set downhole hanger assemblies 210 do not need to be removed later if a lower telemetry unit 124 stops working. If one or more downhole hanger assemblies 210 need to be installed, the method 600 can proceed to block 604. If no more downhole hanger assemblies need to be installed, the method 600 can proceed to block 610.

At block 610, one or more telemetry units of the installed downhole hanger assemblies are initiated. For example, a command can be sent downhole, via telemetry, to get one or more of the telemetry units 212 of the one or more installed downhole hanger assemblies 210 online. The telemetry units 212 in the installed downhole hanger assemblies 210 can be self-healing as known in the art. For example, the telemetry unit 212 of an installed downhole hanger assembly 210 can determine what data from one or more tools and/or from one or more telemetry units 212, 122 the telemetry unit 212 should pass uphole or downhole. Alternatively, each telemetry unit 212, 122 is given a unique address. For example, if a telemetry unit 212 of a downhole hanger assembly 210 is replacing an inoperable telemetry unit 122 (e.g., located externally to the wellbore tubular 120) the telemetry unit 212 of the downhole hanger assembly 210 is given the address of the inoperable telemetry unit 122. If the telemetry unit 212 of the downhole hanger assembly 210 is being used to supplement the existing telemetry units 122, the telemetry unit 212 of the downhole hanger assembly 210 is given a different address. Then the telemetry units 212, 122 above and below the new telemetry unit 212 of the downhole hanger assembly 210 are instructed to listen and respond to information from this telemetry unit 212. After initiation of the one or more telemetry units, the method 600 can proceed to block 612.

At block 612, data is received and transmitted. For example, a telemetry unit 212 of an installed downhole hanger assembly 210 receives data and transmits the data. The transmission can be uphole or downhole. For example, if a command is received for a tool 122 that is downhole from the downhole hanger assembly 210, the telemetry unit 212 of the downhole hanger assembly 210 transmits the command downhole to another telemetry unit 212, 122. If the command is for a tool assembly 122 associated with the downhole hanger assembly 210, the telemetry unit 212 of the downhole hanger assembly 210 transmits the command to the associated tool assembly 122. If the data is received from a downhole telemetry unit 212, 122, the received data can be transmitted uphole. If data is received from a tool assembly 122, e.g., a sensor, associated with the downhole hanger assembly 210, the telemetry unit 212 of the downhole hanger assembly 210 can transmit the data uphole. After transmitting the data, the method 600 can proceed to block 614.

At block 614, a pulling tool is coupled to the set downhole hanger assembly. For example, a pulling tool is lowered down the wellbore tubular 120 using a cable, slickline, e-line or other line and detachably couples with a set downhole hanger assembly 210. More specifically, a coupler, e.g., a female coupler, of the pulling tool couples with the male coupler 402 of the set downhole hanger assembly 210. After coupling a pulling tool to the set downhole hanger assembly, the method 600 can proceed to block 616.

At block 616, a pulling force is applied to the set downhole hanger assembly. For example, a pulling force is applied to the set downhole hanger assembly 210 by the pulling tool thereby causing the one or more sets of slips 410 to return to their stored state. After applying the pulling force to the set downhole hanger assembly, the method 600 can proceed to block 618.

At block 618, the downhole hanger assembly is pulled from the wellbore tubular. For example, the line, such as a cable, slickline, or e-line having the pulling tool coupled with the downhole hanger assembly 210 is pulled from the wellbore tubular 120.

The embodiments shown and described above are only examples. Therefore, many details are neither shown nor described. Even though numerous characteristics and advantages of the present technology have been set forth in the foregoing description, together with details of the structure and function of the present disclosure, the disclosure is illustrative only, and changes can be made in the detail, especially in matters of shape, size and arrangement of the parts within the principles of the present disclosure to the full extent indicated by the broad general meaning of the terms used in the attached claims. It will therefore be appreciated that the embodiments described above can be modified within the scope of the appended claims.

Statements of the Disclosure Include:

Statement 1: a method comprising lowering a downhole hanger assembly comprising a telemetry unit into a wellbore tubular and setting the downhole hanger against an interior wall of the wellbore tubular.

Statement 2: the method according to Statement 1, wherein the downhole hanger assembly comprises a downhole hanger and a telemetry unit.

Statement 3: the method according to Statement 1, wherein the downhole hanger assembly comprises a downhole hanger coupled with a telemetry component having a telemetry unit within the telemetry component.

Statement 4: the method according to Statement 1, further comprising receiving data, by the telemetry unit of the set downhole hanger assembly, from at least one of another telemetry unit located downhole from the set downhole hanger assembly or from a tool assembly located outside of the wellbore tubular and transmitting, by the telemetry unit of the set downhole hanger assembly, the received data uphole.

Statement 5: the method according to Statement 4, wherein the received data is from one of a telemetry unit located outside of the wellbore tubular or a telemetry unit located inside of the wellbore tubular.

Statement 6: the method according to Statement 4, wherein the transmitted data is transmitted to one of a telemetry unit located outside the wellbore tubular or a telemetry unit located inside of the wellbore tubular.

Statement 7: the method according to Statement 4, wherein the tool assembly is a sensor.

Statement 8: the method according to Statement 1, wherein lowering the downhole hanger assembly further comprises lowering a line having an install tool detachably coupled with the downhole hanger assembly.

Statement 9: the method according to Statement 8, wherein setting the downhole hanger assembly further comprises causing one or more slips of the downhole hanger assembly to extend outwardly and contact an interior wall of the wellbore tubular to set the downhole hanger assembly.

Statement 10: the method according to Statement 8, wherein the install tool is a non-explosive install tool.

Statement 11: a downhole hanger assembly comprising a downhole hanger and a telemetry unit.

Statement 12: the downhole hanger assembly according to Statement 11, wherein the telemetry unit resides within the downhole hanger.

Statement 13: the downhole hanger assembly according to Statement 11, wherein the telemetry unit resides in a telemetry component which is coupled with the downhole hanger.

Statement 14: the downhole hanger assembly according to Statement 11, wherein the downhole hanger comprises one or more sets of slips configured to contact and set the downhole hanger assembly against an interior wall of a wellbore tubular.

Statement 15: a wellbore tubular comprising at least one tubing section of a wellbore tubular, the at least one tubing section having an interior wall and an exterior wall and one or more downhole hanger assemblies set against the interior wall of the tubing section, each downhole hanger assembly comprising: a downhole hanger and a telemetry unit.

Statement 16: the wellbore tubular according to Statement 15, wherein the telemetry unit resides in the downhole hanger.

Statement 17: the wellbore tubular according to Statement 15, wherein the telemetry unit resides in a telemetry component which is coupled with the downhole hanger.

Statement 18: the wellbore tubular according to Statement 15, wherein each telemetry unit is configured to receive data, by the telemetry unit of the set downhole hanger assembly, from at least one of another telemetry unit located downhole from the set downhole hanger assembly or from a tool assembly located outside of the wellbore tubular and transmitting, by the telemetry unit of the set downhole hanger assembly, the received data uphole.

Statement 19: the wellbore tubular according to Statement 15, wherein the received data is from one of a telemetry unit located outside of the wellbore tubular or a telemetry unit located inside of the wellbore tubular.

Statement 20: the wellbore tubular according to Statement 15, wherein the transmitted data is transmitted to one of a telemetry unit located outside the wellbore tubular or a telemetry unit located inside of the wellbore tubular.

What is claimed is:

1. A method comprising:

lowering a downhole hanger assembly comprising a downhole hanger coupled with a telemetry unit into a wellbore tubular;

setting the downhole hanger assembly against an interior wall of the wellbore tubular; and engaging the downhole hanger assembly with a telemetry system, the telemetry system comprising a plurality of downhole telemetry units communicatively coupled with one another, wherein one or more the plurality of downhole telemetry units of the telemetry system is located within the wellbore tubular, and one or more of the plurality of downhole telemetry units of the telemetry system is located outside of the wellbore tubular.

2. The method of claim 1 further comprising:

receiving data, via the telemetry unit of the downhole hanger assembly, from at least one of the plurality of downhole telemetry units of the telemetry system or a tool assembly located outside of the wellbore tubular; and transmitting, via the telemetry unit of the downhole hanger assembly, the received data uphole.

3. The method of claim 2, wherein the received data is from one of the plurality of downhole telemetry units located downhole of the downhole hanger assembly.

4. The method of claim 2, wherein the data transmitted via the telemetry unit of the downhole hanger assembly is transmitted to one of the plurality of downhole telemetry units located uphole of the downhole hanger assembly.

5. The method of claim 1 wherein lowering the downhole hanger assembly further comprises lowering a line having an install tool detachably coupled with the downhole hanger assembly.

6. The method of claim 5 wherein setting the downhole hanger assembly further comprises causing one or more slips of the downhole hanger to extend outwardly and contact an interior wall of the wellbore tubular.

7. The method of claim 5 wherein the install tool is a non-explosive install tool.

8. The method of claim 1, further comprising bypassing one or more of the plurality of downhole telemetry units of the telemetry system via the downhole hanger assembly.

9. The method of claim 1, further comprising bypassing one or more of the plurality of downhole telemetry units of the telemetry system via the downhole hanger assembly when one or more of the downhole telemetry units becomes inoperable.

10. A downhole hanger assembly comprising:

a downhole hanger having one or more slips operable to engage an interior wall of a wellbore tubular; and a telemetry unit coupled with the downhole hanger and operable to engage a telemetry system, the telemetry system comprising a plurality of downhole telemetry units communicatively coupled with one another, wherein one or more the plurality of downhole telemetry units of the telemetry system is located within the wellbore tubular, and one or more of the plurality of downhole telemetry units of the telemetry system is located outside of the wellbore tubular.

11. The downhole hanger assembly of claim 10, wherein the telemetry unit of the downhole hanger assembly is operable to bypass one or more of the plurality of downhole telemetry units of the telemetry system.

12. The downhole hanger assembly of claim 10, wherein the telemetry unit of the downhole hanger assembly is operable to bypass one or more of the plurality of downhole telemetry units of the telemetry system when one or more of the plurality of downhole telemetry units becomes inoperable.

13. The downhole hanger assembly of claim 10, wherein the telemetry unit is operable to receive data from one or more of the plurality of downhole telemetry units located downhole of the telemetry unit.

14. The downhole hanger assembly of claim 10, wherein the telemetry unit is operable to transmit data to one or more of the plurality of downhole telemetry units located uphole of the telemetry unit.

15. The downhole hanger assembly of claim 10, wherein the telemetry unit of the downhole hanger assembly is operable to receive data from a tool assembly located outside of the wellbore tubular.

16. A system comprising:

at least one tubing section of a wellbore tubular having an interior wall and an exterior wall;

a telemetry system comprising a plurality of downhole telemetry units communicatively coupled with one another, wherein one or more the plurality of downhole telemetry units of the telemetry system is located within the wellbore tubular, and one or more of the plurality of downhole telemetry units of the telemetry system is located outside of the wellbore tubular; and one or more downhole hanger assemblies set against the interior wall of the tubing section, each downhole hanger assembly comprising:

a downhole hanger comprising one or more slips operable to engage the interior wall of the tubing section; and a telemetry unit coupled with the downhole hanger, wherein the telemetry unit is operable to engage the telemetry system.

17. The system of claim 16 wherein the telemetry unit of each downhole hanger assembly is configured to:

receive data from at least one of the plurality of downhole telemetry units of the telemetry system or a tool assembly located outside of the wellbore tubular; and transmit the received data uphole via one or more of the plurality of downhole telemetry units of the telemetry system located uphole of the downhole hanger assembly.

18. The system of claim 17, wherein the telemetry unit of the downhole hanger assembly is operable to bypass one or more of the plurality of downhole telemetry units of the telemetry system.

19. The system of claim 17, wherein the telemetry unit of the downhole hanger assembly is operable to bypass one or more of the plurality of downhole telemetry units of the telemetry system when one or more of the downhole telemetry units becomes inoperable.

* * * * *